US010003154B2

(12) United States Patent
Koreeda et al.

(10) Patent No.: US 10,003,154 B2
(45) Date of Patent: Jun. 19, 2018

(54) DUST CAP HAVING A HOUSING WITH A CANTILEVER BEAM SECURED TO A SHELL OF A RECEPTACLE BY A COUPLING MEMBER

(71) Applicant: JAPAN AVIATION ELECTRONICS INDUSTRY, LIMITED, Tokyo (JP)

(72) Inventors: Yuichi Koreeda, Tokyo (JP); Naoki Katagiyama, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days. days.

(21) Appl. No.: 15/559,491

(22) PCT Filed: Jan. 20, 2016

(86) PCT No.: PCT/JP2016/051534
§ 371 (c)(1),
(2) Date: Sep. 19, 2017

(87) PCT Pub. No.: WO2016/174883
PCT Pub. Date: Nov. 3, 2016

(65) Prior Publication Data

US 2018/0123280 A1 May 3, 2018

(30) Foreign Application Priority Data

Apr. 27, 2015 (JP) ..... 2015-090589

(51) Int. Cl.
*H01R 13/44* (2006.01)
*H01R 13/46* (2006.01)
(Continued)

(52) U.S. Cl.
CPC ..... *H01R 13/5213* (2013.01); *H01R 13/447* (2013.01); *H01R 13/625* (2013.01)

(58) Field of Classification Search
CPC .... H01R 11/284; H01R 13/44; H01R 13/447; H01R 13/4536; H01R 13/46; H01R 13/516; H01R 13/5213; H01R 13/701
(Continued)

(56) References Cited

U.S. PATENT DOCUMENTS 6,293,423 B1 9/2001 Masuda et al.
7,470,858 B2 * 12/2008 McNutt ..... H01R 13/447 174/135
(Continued)

FOREIGN PATENT DOCUMENTS

JP H01-104670 U 7/1989
JP H11-126649 A 5/1999
JP 2012-226864 A 11/2012

OTHER PUBLICATIONS

Search Report issued in International Application No. PCT/JP2016/051534, dated Apr. 5, 2016.

*Primary Examiner* — Chandrika Prasad
(74) *Attorney, Agent, or Firm* — Greenblum & Bernstein, P.L.C.

(57) ABSTRACT

A dust cap to be mounted to a receptacle of a bayonet locking connector when a plug is not connected to the receptacle includes a housing that has an insertion part, at a front end thereof, to be inserted into a shell of the receptacle, with rotation thereof being restricted, a lid part at a back end thereof, and a cantilever beam between the insertion part and the lid part, the cantilever beam extending in a direction intersecting with the insertion direction in which the insertion part is inserted; and a coupling that has a cylindrical inner circumferential surface, and a protrusion for bayonet locking on the inner circumferential surface at a front end of the coupling, the coupling being mounted so as to be capable
(Continued)

of rotating around the housing, and a back end of the coupling being closed by the lid part.

20 Claims, 8 Drawing Sheets

(51) Int. Cl.
*H01R 13/52* (2006.01)
*H01R 13/625* (2006.01)
*H01R 13/447* (2006.01)

(58) Field of Classification Search
USPC ..... 439/135, 142, 367, 892
See application file for complete search history.

(56) References Cited

U.S. PATENT DOCUMENTS

| | | | | |
|---|---|---|---|---|
| 2007/0012474 | A1 | 1/2007 | McNutt et al. | |
| 2009/0130892 | A1* | 5/2009 | Pech | H01R 13/625<br>439/374 |
| 2009/0163058 | A1* | 6/2009 | Craig | H01R 13/447<br>439/147 |
| 2016/0111810 | A1* | 4/2016 | Horstmann | H01R 13/5213<br>439/660 |

* cited by examiner

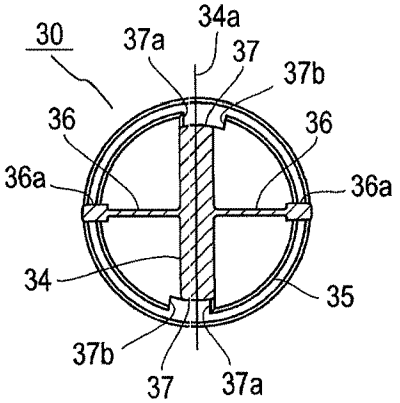
FIG. 5A
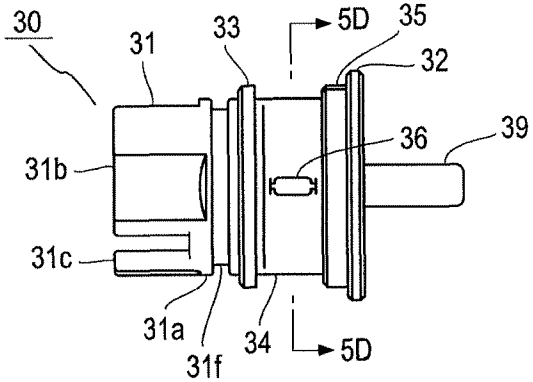
FIG. 5B
FIG. 5D
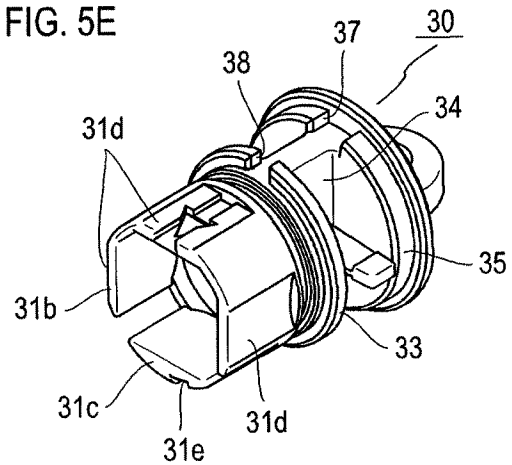
FIG. 5E
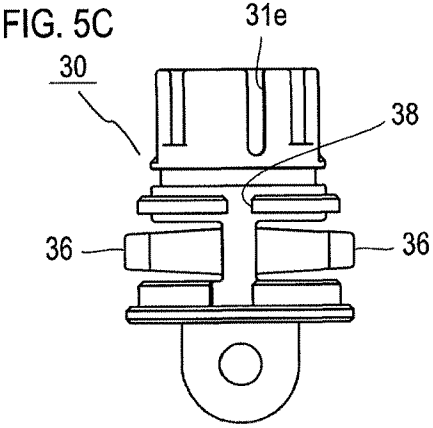
FIG. 5C
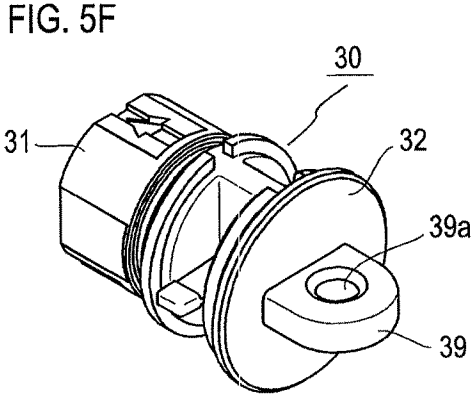
FIG. 5F

DUST CAP HAVING A HOUSING WITH A CANTILEVER BEAM SECURED TO A SHELL OF A RECEPTACLE BY A COUPLING MEMBER

TECHNICAL FIELD

The present invention related to a dust cap to be mounted to a connector to which a mating connector is not connected.

BACKGROUND ART

FIGS. 1A and 1B show a structure described in Patent Literature 1 as a conventional example of this type of dust cap. FIG. 2 shows a state in which the dust cap shown in FIGS. 1A and 1B is mounted to a connector (round connector).

A dust cap 10 is provided with rivet guide slots 10*a* for guiding rivets 15*a* of a connector 15 for smooth insertion when the dust cap 10 is mounted to and secured to the connector 15, and a rivet securing surface 10*b* having a planar structure that allows the rivets 15*a* to be secured when the dust cap 10 is secured to the connector 15. For dust proofing, a dust proof member 11, such as silicone rubber, is provided at an insertion end part 10*c* that the top of the connector 15 touches when the connector 15 is inserted.

To mount the dust cap 10 to the connector 15, the rivet guide slots 10*a* are aligned with the positions of the rivets 15*a*, the dust cap 10 is inserted into the connector 15, the dust cap 10 is pressed to the connector 15, and the dust cap 10 is rotated when the rivets 15*a* pass through the rivet securing surface 10*b*. With this operation, the dust cap 10 is secured by the rivets 15*a* and the rivet securing surface 10*b* due to the repulsive force of the dust proof member 11.

PRIOR ART LITERATURE

Patent Literature

Patent Literature 1: Japanese Utility Model Registration Application Laid Open No. H1-104670

SUMMARY OF THE INVENTION

Problems to be Solved by the Invention

In the mounting structure of the dust cap 10, described above, the dust proof member 11, such as silicone rubber, provided inside the dust cap 10, is pressed against the top of the connector 15 to generate the repulsive force caused by the elasticity of the dust proof member 11. With this repulsive force, the dust cap 10 is locked to the connector 15.

Therefore, stress is always applied to the dust proof member 11 in the locking state of the dust cap 10. When the dust proof member 11 is used for a long period under such stress, the silicone rubber of the dust proof member 11 deteriorates, that is, is hardened, reducing the elasticity, and causing the locking force to decrease and the dust cap 10 to come off easily.

An object of the present invention is to provide a dust cap having a locking force that does not decrease even if the dust cap is used for a long period, and therefore, not coming off easily.

Means to Solve the Problems

According to the present invention, a dust cap to be mounted to a receptacle of a bayonet locking connector when a plug is not connected to the receptacle, includes a housing that includes an insertion part, at a front end thereof, to be inserted into a shell of the receptacle, with rotation thereof in the circumferential direction of the shell being restricted; a lid part at a back end thereof; and a cantilever beam between the insertion part and the lid part, the cantilever beam extending in a direction intersecting with the insertion direction in which the insertion part is inserted; and a coupling that includes a cylindrical inner circumferential surface; and a protrusion for bayonet locking on the inner circumferential surface at a front end of the coupling; the coupling being mounted around the housing so as to be capable of rotating relative to the housing and a back end of the coupling being closed by the lid part. A tip portion of the cantilever beam is located within a groove formed on the inner circumferential surface of the coupling; the cantilever beam is not bent in a locking state in which the protrusion is fitted into a depression for bayonet locking, formed on an outer circumferential surface of the shell; and when the coupling is rotated relative to the housing in order to release the locking state, the tip portion of the cantilever beam is pushed by an inner wall of the groove to bend the cantilever beam.

Effects of the Invention

According to the present invention, the cantilever beam used to keep the locking state of the dust cap against the receptacle is not subjected to stress during the locking state. Therefore, even if the cantilever beam is used for a long period, it does not deteriorate or the elasticity does not decrease. The locking force is not reduced. As a result, a dust cap having reliability in terms of not easily coming off can be provided.

BRIEF DESCRIPTION OF THE DRAWINGS

FIG. 5A is a front view of a housing shown in FIG. 3C;

FIG. 5B is a right side view of the housing shown in FIG. 5A;

FIG. 5C is a bottom view of the housing shown in FIG. 5A;

FIG. 5D is a cross-sectional view along line 5D-5D shown in FIG. 5B;

FIG. 5E is a perspective view of the housing shown in FIG. 5A;

FIG. 5F is another perspective view of the housing shown in FIG. 5A;

DETAILED DESCRIPTION OF THE EMBODIMENTS

An embodiment of the present invention will be described below.

Figure 1A:
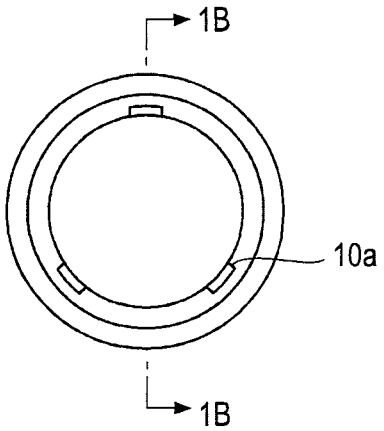
FIG. 1A PRIOR ART
FIG. 1A is a front view showing a conventional example of a dust cap.
Figure 1B:
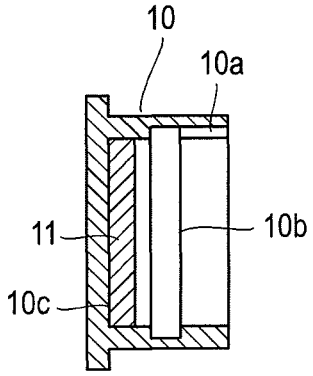
FIG. 1B PRIOR ART
FIG. 1B is a cross-sectional view along line 1B-1B shown in FIG. 1A.
Figure 2:
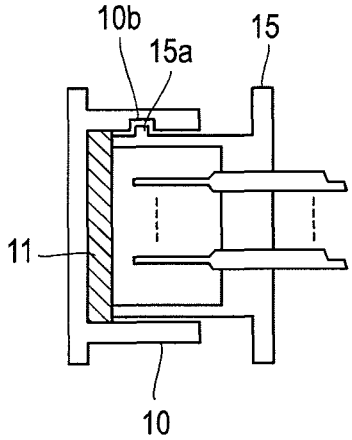
FIG. 2 PRIOR ART
FIG. 2 is a cross-sectional view showing a state in which the dust cap shown in FIGS. 1A and 1B is mounted to a connector.
Figure 3A:
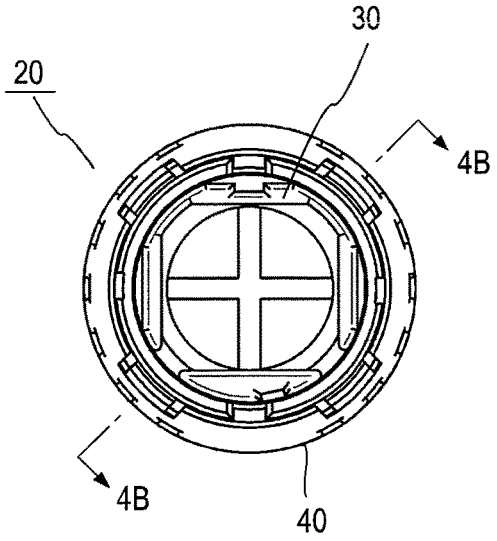
FIG. 3A is a front view showing a dust cap according to an embodiment of the present invention.
Figure 3B:
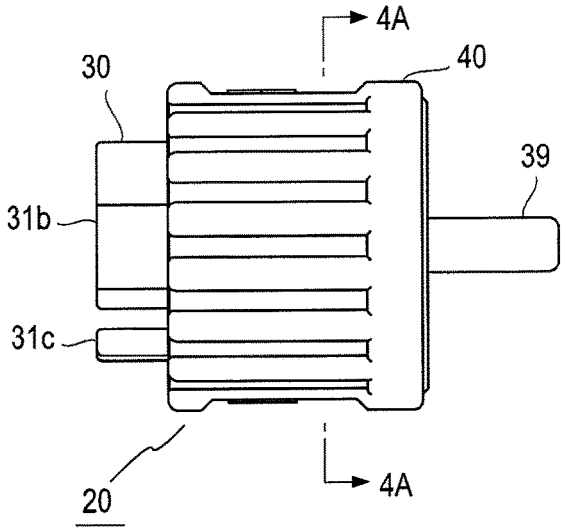
FIG. 3B is a right side view of the dust cap shown in FIG. 3A.
Figure 3C:
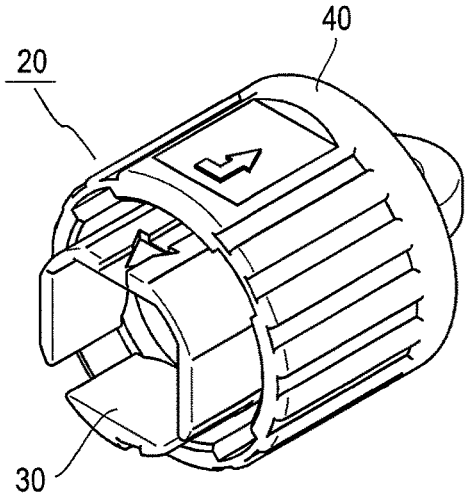
FIG. 3C is a perspective view of the dust cap shown in FIG. 3A.
Figure 4A:
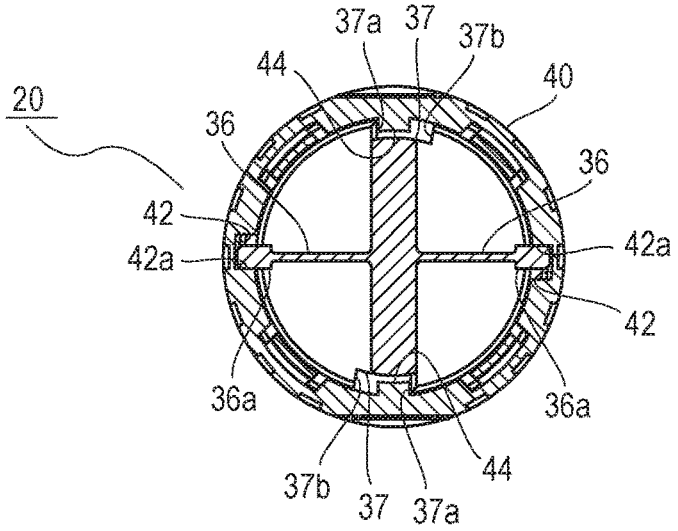
FIG. 4A is a cross-sectional view along line 4A-4A shown in FIG. 3B.
Figure 4B:
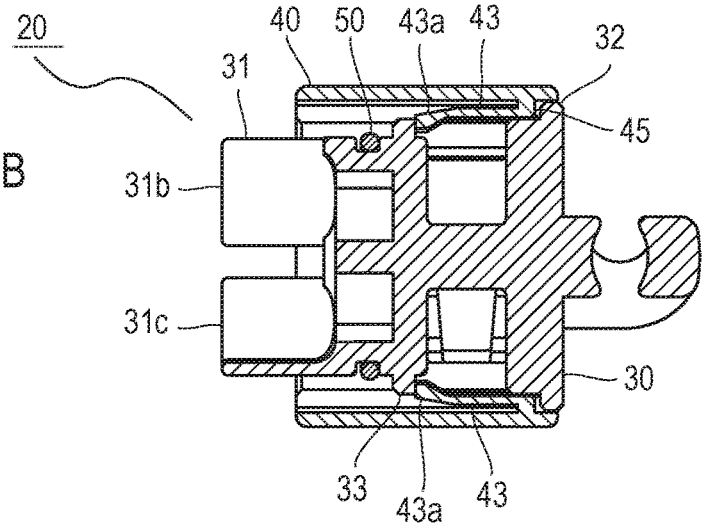
FIG. 4B is a view showing a cross section along line 4B-4B shown in FIG. 3A, with the backward and forward directions aligned with those in the right side view shown in FIG. 3B.
Figure 4C:
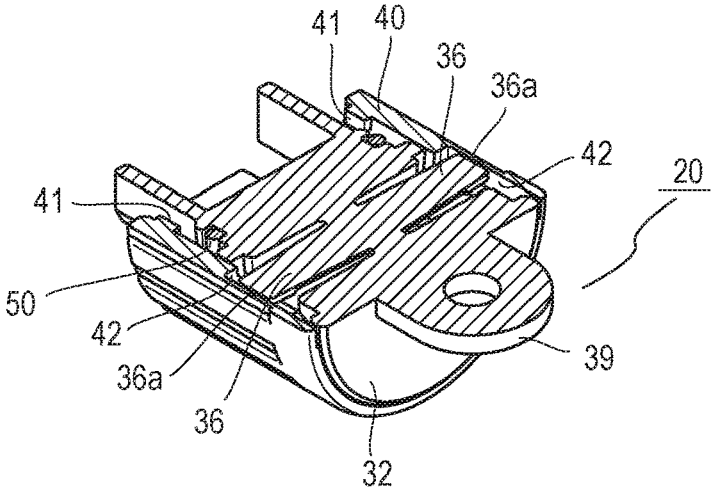
FIG. 4C is a perspective view of the dust cap shown in FIG. 3B when cut transversely.
Figure 6C:
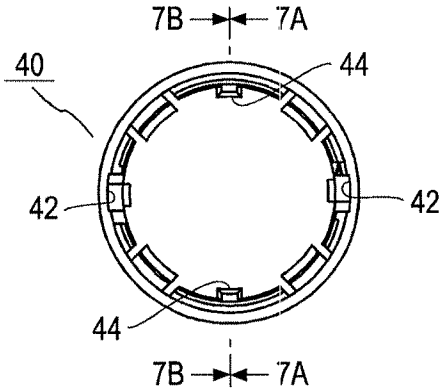
FIG. 6C is a rear view of the coupling shown in FIG. 6A.
Figure 6B:
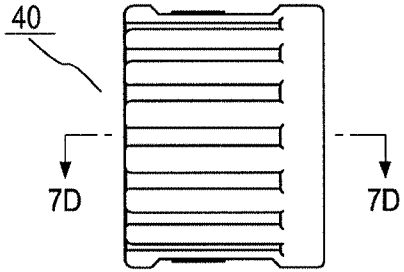
FIG. 6B is a right side view of the coupling shown in FIG. 6A.
Figure 6A:
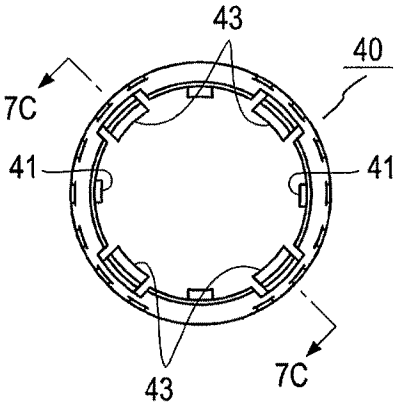
FIG. 6A is a front view of a coupling shown in FIG. 3C.
Figure 6E:
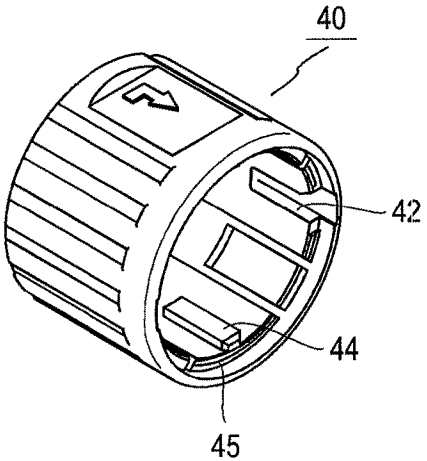
FIG. 6E is another perspective view of the coupling shown in FIG. 6A.
Figure 6D:
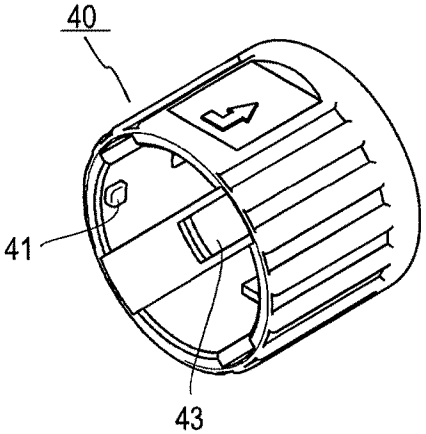
FIG. 6D is a perspective view of the coupling shown in FIG. 6A.

FIGS. 3A-3C show the external appearance of a dust cap according to an embodiment of the present invention. FIGS. 4A-4C show cross-sectional structures of the dust cap. A dust cap 20 is to be mounted to a receptacle of a bayonet-locking connector formed of the receptacle and a plug, when the plug is not connected to the receptacle. The dust cap 20 is formed of a housing 30, a coupling 40, and an O-ring 50. FIGS. 5A-5F show details of the housing 30. FIGS. 6A-6E and FIGS. 7A-7D show details of the coupling 40.

The housing 30 is provided with, at a front end, an insertion part 31 to be inserted into the shell of the receptacle, as shown in FIG. 5B, and at a back end, a disc-shaped lid part 32. The insertion part 31 is formed of a cylindrical portion 31*a*, and insertion pieces 31*b* and 31*c* formed to protrude forward from the cylindrical portion 31*a*. The insertion piece 31*b* is formed to protrude forward to have a C-shaped cross section from a region occupying about three-fourths of the circumference of the cylindrical portion 31*a*. The insertion piece 31*c* is formed to protrude from the remaining one-fourth of the circumference of the cylindrical portion 31*a*.

At the outer circumferential surface of the insertion piece 31*b*, having a C-shaped cross section, three flat portions 31*d* are formed by cutting the cylindrical surface at intervals of 90 degrees. These three flat portions 31*d* are formed to be located at the center and both ends of the C shaped insertion piece 31*b*. At the outer surface (outer circumferential surface) of the insertion piece 31*c*, a groove portion 31*e* is formed to extend in the direction in which the insertion piece 31*c* protrudes. These flat portions 31*d* and the groove portion 31*e* are formed up to positions a little inside the cylindrical portion 31*a*. A ring-shaped groove 31*f* is formed at the outer circumferential surface of the cylindrical portion 31*a*. A rib 31*g* for reinforcement is provided in the shape of a cross inside the cylindrical portion 31*a*.

A disc part 33, a prism-shaped pillar part 34, and a disc part 35 are formed in that order from the insertion part 31, between the insertion part 31 and the lid part 32. The pillar part 34 is further provided with a pair of cantilever beams 36. The disc parts 33 and 35 have outer diameters larger than the cylindrical part 31 and smaller than the lid part 32.

The pillar part 34 is formed along diameter lines of the disc parts 33 and 35, except at both ends of the diameter lines. The pair of cantilever beams 36 are formed to protrude respectively outward from both mutually opposing side faces of the pillar part 34. The pair of cantilever beams 36 are formed along a diameter line perpendicular to the diameter lines of the disc parts 33 and 35 along which the pillar part 34 is located. The pillar part 34 and the pair of cantilever beams 36 form a cross shape in cross section, as shown in FIG. 5D. The pair of cantilever beams 36 have thin plate shapes and become slightly narrow in width towards the tips thereof. In this example, the tip portions 36*a* of the cantilever beams 36 are slightly thick in depth.

On the circumferential edge of the disc part 35, two notches 37 are provided at the top and bottom on the diameter line where the pillar part 34 is located. The centers of the widths of the notches 37 in the circumferential direction are shifted clockwise with respect to the center line 34*a* of the pillar part 34, as shown in FIG. 5D. Two notches 38 are also provided at the top and bottom on the circumferential edge of the disc part 33. The inside bottom surfaces of the notches 37 and 38 are extensions of the side faces of the pillar part 34 where the cantilever beams 36 are not formed.

A knob 39 is formed to protrude at the center of the outer surface (outside plate face) of the lid part 32, having a disc shape. The knob 39 has a through hole 39*a*.

The coupling 40 has a cylindrical shape, as shown in FIGS. 6A-6E and FIGS. 7A-7D. Protrusions 41 for bayonet locking are formed to protrude at locations 180 degrees apart from each other on the inner circumferential surface at the front end of the coupling 40. Grooves 42 are formed at locations 180 degrees apart from each other on the circumferential surface of the coupling 40, the locations being on extensions from the locations where the protrusions 41 exist. The grooves 42 are formed to extend from the back end of the coupling 40 to almost the center along the center axis of the coupling 40.

In addition to the two grooves 42, four slip preventing pieces 43 and two protruding parts 44 are formed to protrude on the half of the inner circumferential surface close to the back end of the coupling 40. The protruding parts 44 are formed at locations 90 degrees apart from the grooves 42 in the circumferential direction of the coupling 40. The slip preventing pieces 43 are formed at locations 45 degrees apart from the grooves 42 and the protruding parts 44 in the circumferential direction of the coupling 40.

Figure 7A:
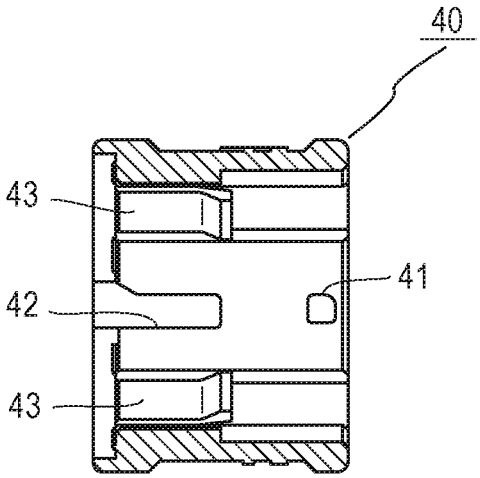
FIG. 7A is an enlarged cross-sectional view along line 7A-7A shown in FIG. 6C.
Figure 7B:
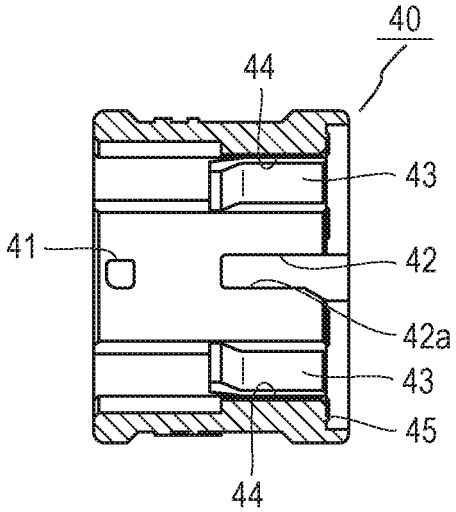
FIG. 7B is an enlarged cross-sectional view along line 7B-7B shown in FIG. 6C.
Figure 7C:
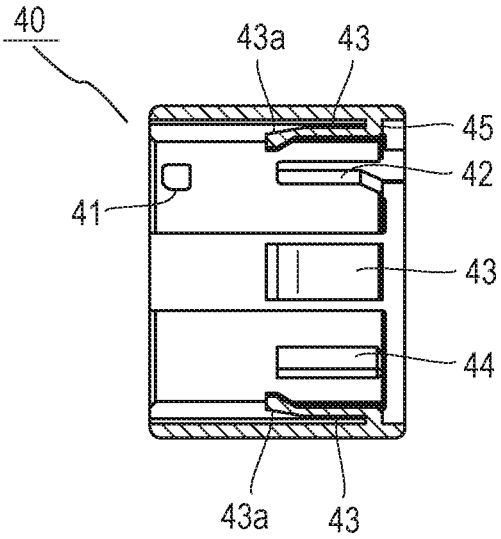
FIG. 7C is an enlarged cross-sectional view along line 7C-7C shown in FIG. 6A.
Figure 7D:
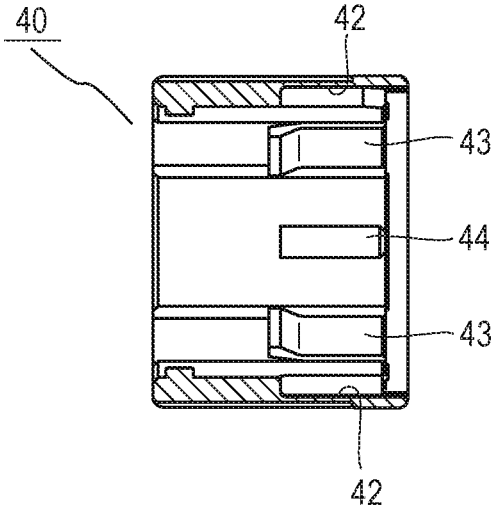
FIG. 7D is an enlarged cross-sectional view along line 7D-7D shown in FIG. 6B.

The slip preventing pieces 43 extend forward (to the front end of the coupling 40) with their supporting ends located close to the back end of the coupling 40, and their free ends 43*a* stand so as to be away from the inner circumferential surface of the coupling 40, as shown in FIG. 7C. The protruding parts 44 have a narrow key shape. The back ends of the slip preventing pieces 43 and the protruding parts 44 are located slightly inward from the back end of the coupling 40. The inner diameter of the coupling 40 at a location farther backward than the back ends of the slip preventing pieces 43 and the protruding parts 44 is made slightly larger than the inner diameter thereof at the forward side, forming a step 45.

In this example, the housing 30 and the couple 40, having the above described shapes, are made of a resin.

Figure 8:
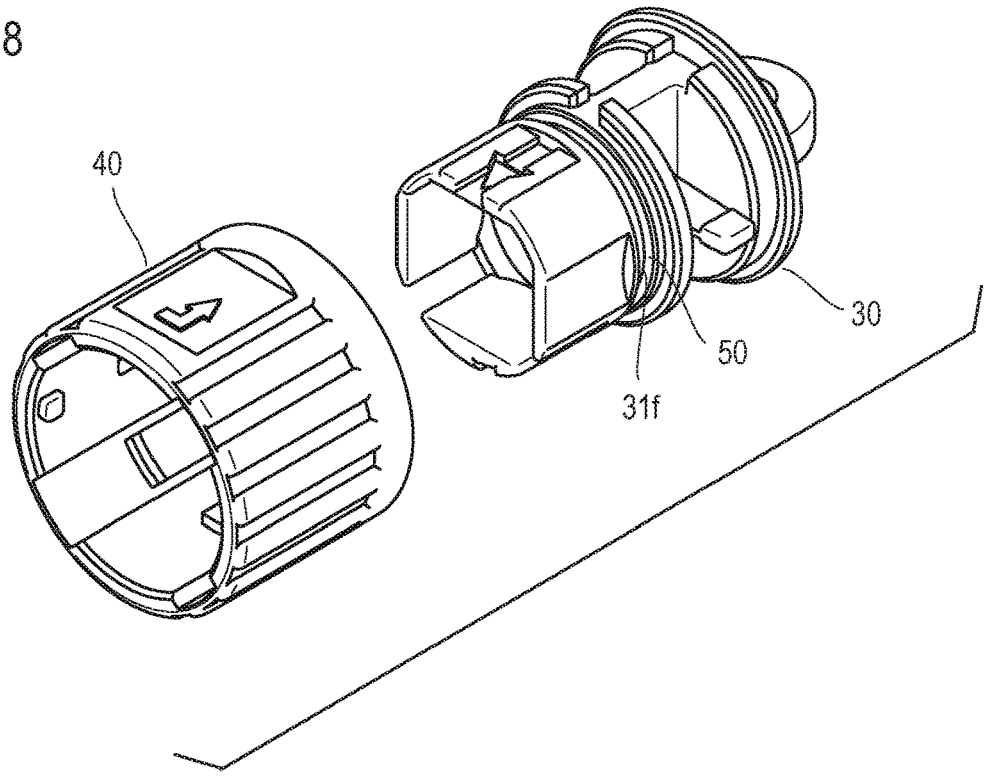
FIG. 8 is a view illustrating the assembly of the dust cap shown in FIG. 3C.

The O-ring 50 is mounted in the groove 31*f* of the housing 30. The housing 30 is inserted and pushed into the coupling 40 from the back end of the coupling 40, as shown in FIG. 8 to make the dust cap 20, shown in FIGS. 3A-3C and FIGS. 4A-4C.

When the housing 30 is pushed into the coupling 40, the disc part 33 of the housing 30 causes the free ends 43*a* of the four slip preventing pieces 43 of the coupling 40 to extend outward and passes through the free ends 43*a*, and the extended free ends 43*a* return due to their elasticity. Then, the slip preventing pieces 43 are caught at the circumferential edge of the disc part 33, as shown in FIG. 4B.

The lid part 32 of the housing 30 is accommodated at the back end of the coupling 40, as shown in FIG. 4B. Since the lid part 32 butts against the step 45, the housing 30 is prevented from being pushed further. The back end of the coupling 40 is closed by the lid part 32.

The coupling 40 is prevented from slipping forward against the housing 30 when the free ends 43*a* of the slip preventing pieces 43 butt against the disc part 33 of the housing 30, and is also prevented from slipping backward against the housing 30 when the step 45 butts against the lid part 32, thus being mounted around the housing 30.

The tip portions 36*a* of the pair of cantilever beams 36, formed in the housing 30, are respectively positioned in the grooves 42 of the coupling 40, as shown in FIGS. 4A and 4C. The two protruding parts 44, forming in the coupling 40, are respectively positioned in the notches 37 of the housing 30, as shown in FIG. 4A. The coupling 40 ran be rotated relative to the hanging 30 by an amount corresponding to the amount by which the protruding parts 44 can move in the notches 37 in the circumferential direction. The tips of the insertion pieces 31*b* and 31*c* of the housing 30 protrude from the front end of the coupling 40, and the knob 39 protrudes from the back end of the coupling 40.

How the dust cap 20, having the above described structure, is mounted to a receptacle will be described next.

Figure 9:
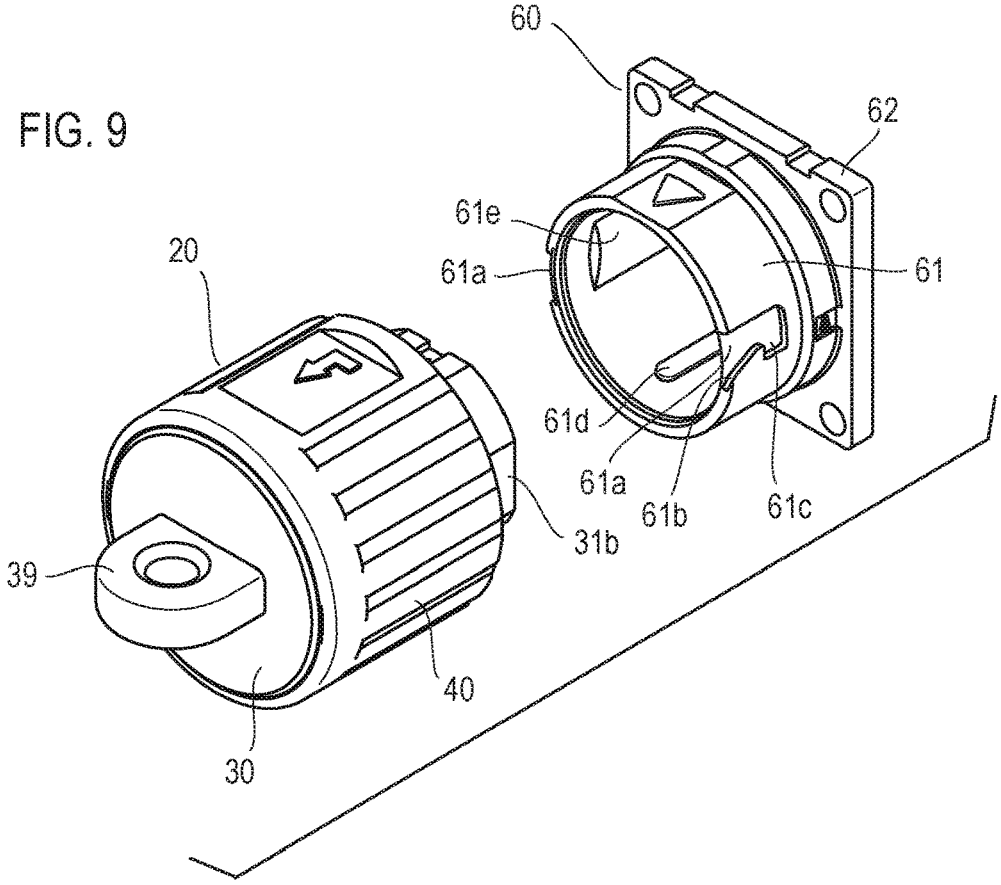
FIG. 9 is a view illustrating how the dust cap is mounted to a receptacle.
Figure 10:
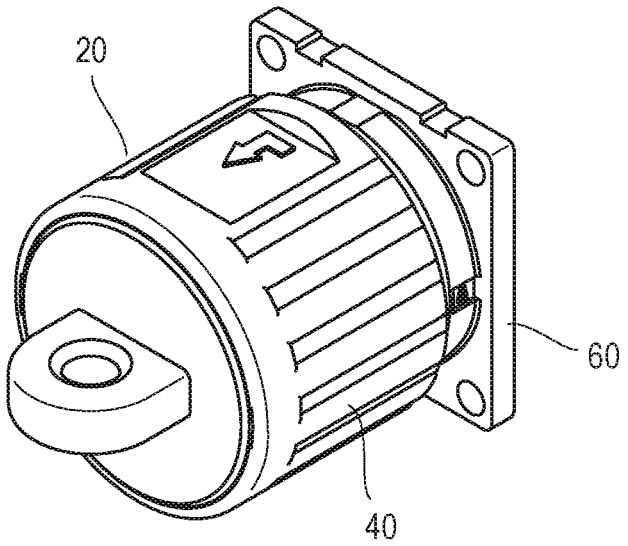
FIG. 10 is a perspective view showing a state in which the dust cap is mounted to the receptacle.
Figure 11:
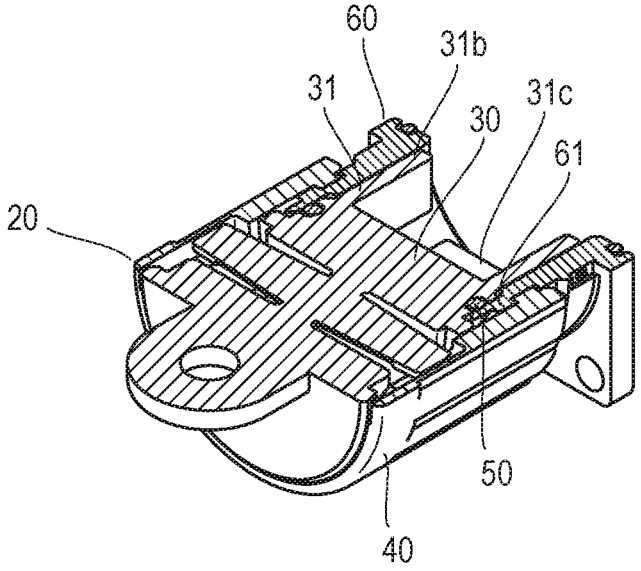
FIG. 11 is a perspective view of the dust cap and the receptacle shown in FIG. 10 when they are cut transversely.

FIG. 9 shows a state before the dust cap 20 is mounted to a receptacle. FIG. 10 shows a state after the dust cap 20 is mounted to the receptacle. FIG. 11 shows a cross-sectional structure of the dust cap 20 and the receptacle mounted to each other. In FIGS. 9 to 11, the receptacle is shown only with the shell thereof and the other structural elements of the receptacle are not shown.

A shell 60 of the receptacle is formed of a cylindrical part 61 and a flange 62 provided at one end of the cylindrical part 61. A pair of guide grooves 61*a* for bayonet locking are formed on the outer circumferential surface of the cylindrical part 61. Each of the guide grooves 61*a* has a slanted surface 61*b* at one of its side walls at the entry and also has a depression 61*c* behind the slanted surface 61*b*. The slanted surfaces 61*b* and the depressions 61*c* of the pair of guide grooves 61*a* are provided so as to be 180-degree rotationally symmetric.

On the other hand, on the inner circumferential surface of the cylindrical part 61, a protruding bar 61*d* is formed to protrude along the center axis of the cylindrical part 61 and three planar portions 61*e* are formed to protrude at intervals of 90 degrees. In FIG. 9, only one planar portion 61*e* is shown and the others are hidden. The flat portions 31*d*, provided on the outer circumferential surface of the insertion piece 31*b* of the housing 30 of the dust cap 20, correspond to these planar portions 61*e* of the cylindrical part 61.

To mount the dust cap 20 to the receptacle, the knob 39 of the housing 30 is pinched, the insertion pieces 31*b* and 31*c* are inserted into the cylindrical part 61 of the shell 60, and the dust cap 20 is pushed, for example. In this case, the protruding bar 61*d* of the shell 60, which is formed to extend in the direction in which the insertion pieces 31*b* and 31*c* are inserted, is fitted into the groove portion 31*e* of the insertion piece 31*c*, and also the outer circumferential shape of the insertion piece 31*b*, on which the three flat portions 31*d* are formed, matches the inner circumferential shape of the cylindrical part 61, having the three planar portions 61*e*, thus positioning the insertion pieces 31*b* and 31*c*, that is, restricting the rotation of the housing 30, in the circumferential direction of the cylindrical part 61 of the shell 60.

When the dust cap 20 is pushed into the receptacle, the pair of protrusions 41 of the coupling 40 butt against the slanted surfaces 61*b* of the guide grooves 61*a* of the shell 60, then the pair of protrusions 41 are guided by the slanted surfaces 61*b*, and only the coupling 40 rotates. The pair of cantilever beams 36 of the housing 30 are not bent in their initial state, as shown in FIG. 4A. More specifically, the tip portions 36*a* of the cantilever beams 36, located in the grooves 42 of the coupling 40, are not pushed by the inner walls 42*a* of the grooves 42. When the coupling 40 starts rotating, the tip portions 36*a* of the cantilever beams 36 are pushed by the inner walls 42*a* of the grooves 42, and the pair of cantilever beams 36 start bending as the coupling 40 rotates.

When the dust cap 20 is pushed further, the protrusions 41 of the coupling 40 get over the slanted surfaces 61*b*, and then, the pair of cantilever beams 36, which have bent, return to their initial state by elasticity. When the cantilever beams 36 return, the tip portions 36*a* of the cantilever beams 36 push the inner walls 42*a* of the grooves 42 to rotate the coupling 40 in the reverse direction, fitting the protrusions 41 into the depressions 61*c*, located behind the slanted surfaces 61*b*, to reach the locking state.

The dust cap 20 is mounted to the shell 60 of the receptacle in this manner and, in the locking state, closes the opening of the shell 60. The pair of cantilever beams 36 of the dust cap 20 are not bent in the locking state. The cantilever beams 36 are in the initial state but keep the locking state.

On the other hand, when the coupling 40 is rotated relative to the housing 30 so as to cause the protrusions 41 of the coupling 40 to slip out from the depressions 61*c* in the shell 60 to release the locking state to remove the dust cap 20, the tip portions 36*a* of the pair of cantilever beams 36 are pushed by the inner walls 42*a* of the grooves 42 of the coupling 40 and are bent in the same manner as when the dust cap 20 is mounted. When the dust cap 20 is removed from the receptacle, the cantilever beams 36 return to the initial state, where the cantilever beams 36 are not bent.

When the coupling 40 is rotated in either direction, excessive rotation is prevented because the two protruding parts 44 formed in the coupling 40 butt against the butting surfaces 37*a* and 37*b* formed of both side walls of the notches 37 made in the disc part 35 of the housing 30. Therefore, the cantilever beams 36 are prevented from being broken due to excessive bending.

As explained above, according to the dust cap 20 described above, no stress is applied to the cantilever beams 36 in the locking state for the receptacle; therefore, the locking force is not reduced even during long use; and thus, the dust cap does not come off easily.

When the dust cap 20 is mounted to the shell 60, the cylindrical part 61 of the shell 60 is placed between the coupling 40 and the insertion part 31 of the housing 30 of the dust cap 20, and the inner circumferential surface of the cylindrical part 61 and the housing 30 sandwich the O-ring 50, as shown in FIG. 11. The O-ring 50 is provided to achieve a superior dust-proof structure in this example.

Also in this example, the housing 30 of the dust cap 20 has the insertion pieces 31*b* and 31*c*, which are sufficiently placed inside the cylindrical part 61 of the shell 60, as shown in FIG. 11. Since the insertion pieces 31*b* and 31*c* are placed inside and sufficiently overlap with the cylindrical part 61 of the shell 60, the dust cap 20 has an improved mounting strength. Even if an external force is applied to the dust cap 20 transversely, for example, the dust cap 20 does not easily come off or is not easily broken.

In this example, the coupling 40 has a cylindrical shape at the outside. The outside shape of the coupling 40 can be any shape so long as the coupling 40 has an inner circumferential surface appropriate for the cylindrical part 61 of the shell 60.

In this example, the tip portions 36*a* of the cantilever beams 36 are thick to some degree in depth. Instead of being made thick, the cantilever beams 36 can have a uniform thickness. If the thickness of the tip portions 36*a* becomes large, it is easier to form the grooves 42 in the coupling 40, where the tip portions 36*a* are accommodated.

In the above-described example, the housing 30 is made of a resin. In stead of a resin, the housing 30 may be made of a metal. The cantilever beams 36 may be made of a metal, and the housing 30 may be resin-molded with the cantilever beams 36 being mounted by insertion molding or press fitting.

In this example, although the two cantilever beams 36 are provided, three or more cantilever beams 36 or one cantilever beam 36 may be provided. When a plurality of cantilever beams 36 are provided, it is preferred that the tip portions thereof be located at positions rotationally symmetric with respect to the center axis of the coupling 40.

In the above-described example, the cantilever beam 36 is supported by the prism-shaped pillar part 34. In other words, the supporting end of the cantilever beam 36 is located at the center part of the housing 30, and the cantilever beam 36 extends outward from the center part of the housing 30. The supporting block (in the above described example, the prism-shaped pillar part 34) that supports the cantilever beam 36 may be shifted in position from the center part of the housing 30 to make the supporting end of the cantilever beam 36 shifted from the center part of the housing 30, for example. When the supporting end of the cantilever beam 36 is positioned in that way, the cantilever beam 36 becomes longer.

In the above described example, the cantilever beams 36 extend in the directions perpendicular to that in which the insertion part 31 is inserted into the shell 60. The cantilever beams 36 do not necessarily extend in the directions perpendicular to that in which the insertion part 31 is inserted. The cantilever beams 36 need to extend in directions intersecting with the direction in which the insertion part 31 is inserted.

What is claimed is:

1. A dust cap to be mounted to a receptacle of a bayonet locking connector when a plug is not connected to the receptacle, the dust cap comprising:

a housing comprising:

an insertion part, at a front end thereof, to be inserted into a shell of the receptacle, with rotation thereof in the circumferential direction of the shell being restricted, a lid part at a back end thereof, and a cantilever beam between the insertion part and the lid part, the cantilever beam extending in a direction intersecting with the insertion direction in which the insertion part is inserted; and a coupling comprising:

a cylindrical inner circumferential surface, and a protrusion for bayonet locking on the inner circumferential surface at a front end of the coupling, the coupling being mounted around the housing so as to be capable of rotating relative to the housing and a back end of the coupling being closed by the lid part;

a tip portion of the cantilever beam being located within a groove formed on the inner circumferential surface of the coupling;

the cantilever beam being not bent in a locking state in which the protrusion is fitted into a depression for bayonet locking, formed on an outer circumferential surface of the shell; and when the coupling is rotated relative to the housing in order to release the locking state, the tip portion of the cantilever beam being pushed by an inner wall of the groove to bend the cantilever beam.

2. The dust cap according to claim 1, further comprising one or more cantilever beams identical to the cantilever beam, wherein the tip portions of the plurality of cantilever beams are located at positions rotationally symmetrical with respect to the center axis of the coupling.

3. The dust cap according to claim 1, wherein a groove portion is formed in an outer surface of the insertion part, a protruding bar extending in the insertion direction and being formed on an inner circumferential surface of the shell being fitted into the groove portion.

4. The dust cap according to claim 2, wherein a groove portion is formed in an outer surface of the insertion part, a protruding bar extending in the insertion direction and being formed on an inner circumferential surface of the shell being fitted into the groove portion.

5. The dust cap according to claim 1, wherein a protruding part is formed to protrude from the inner circumferential surface of the coupling; and a butting surface is formed in the housing, the protruding part butting against the butting surface to prevent excessive rotation of the coupling.

6. The dust cap according to claim 2, wherein a protruding part is formed to protrude from the inner circumferential surface of the coupling; and a butting surface is formed in the housing, the protruding part butting against the butting surface to prevent excessive rotation of the coupling.

7. The dust cap according to claim 3, wherein a protruding part is formed to protrude from the inner circumferential surface of the coupling; and a butting surface is formed in the housing, the protruding part butting against the butting surface to prevent excessive rotation of the coupling.

8. The dust cap according to claim 4, wherein a protruding part is formed to protrude from the inner circumferential surface of the coupling; and a butting surface is formed in the housing, the protruding part butting against the butting surface to prevent excessive rotation of the coupling.

9. The dust cap according to claim 1, wherein an O-ring is mounted to an outer circumferential surface of the housing, the O-ring being sandwiched by the inner circumferential surface of the shell and the housing.

10. The dust cap according to claim 2, wherein an O-ring is mounted to an outer circumferential surface of the housing, the O-ring being sandwiched by the inner circumferential surface of the shell and the housing.

11. The dust cap according to claim 3, wherein an O-ring is mounted to an outer circumferential surface of the housing, the O-ring being sandwiched by the inner circumferential surface of the shell and the housing.

12. The dust cap according to claim 4, wherein an O-ring is mounted to an outer circumferential surface of the housing, the O-ring being sandwiched by the inner circumferential surface of the shell and the housing.

13. The dust cap according to claim 5, wherein an O-ring is mounted to an outer circumferential surface of the housing, the O-ring being sandwiched by the inner circumferential surface of the shell and the housing.

14. The dust cap according to claim 6, wherein an O-ring is mounted to an outer circumferential surface of the housing, the O-ring being sandwiched by the inner circumferential surface of the shell and the housing.

15. The dust cap according to claim 7, wherein an O-ring is mounted to an outer circumferential surface of the housing, the O-ring being sandwiched by the inner circumferential surface of the shell and the housing.

16. The dust cap according to claim 8, wherein an O-ring is mounted to an outer circumferential surface of the housing, the O-ring being sandwiched by the inner circumferential surface of the shell and the housing.

17. The dust cap according to claim 1, wherein a knob is formed to protrude from an outer surface of the lid part.

18. The dust cap according to claim 2, wherein a knob is formed to protrude from an outer surface of the lid part.

19. The dust cap according to claim 3, wherein a knob is formed to protrude from an outer surface of the lid part.

20. The dust cap according to claim 4, wherein a knob is formed to protrude from an outer surface of the lid part.

* * * * *